US012245709B2

(12) United States Patent
Kwak

(10) Patent No.: US 12,245,709 B2
(45) **Date of Patent: *Mar. 11, 2025**

(54) REVERSIBLE MULTI-CONFIGURATION MODULAR DINNERWARE / COOKWARE / SERVEWARE APPARATUS AND METHOD

(71) Applicant: Chapter Ceramics, San Diego, CA (US)

(72) Inventor: Janet Kwak, San Diego, CA (US)

(73) Assignee: Chapter Ceramics, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/384,763

(22) Filed: Oct. 27, 2023

(65) Prior Publication Data

US 2024/0057797 A1 Feb. 22, 2024

Related U.S. Application Data

(63) Continuation of application No. 17/420,044, filed as application No. PCT/US2020/059232 on Nov. 5, 2020, now Pat. No. 11,800,943.

(60) Provisional application No. 62/931,111, filed on Nov. 5, 2019.

(51) Int. Cl.
*A47G 19/08* (2006.01)

(52) U.S. Cl.
CPC ..... *A47G 19/08* (2013.01)

(58) Field of Classification Search
CPC ..... A47G 19/08; A47G 19/00; A47G 19/02; A47F 7/0064; A47J 47/16; A47B 81/04
See application file for complete search history.

(56) References Cited

U.S. PATENT DOCUMENTS

| | | | |
|---|---|---|---|
| 1,514,313 | A | 11/1924 | Davenport |
| 10,321,779 | B1 | 6/2019 | Thai |
| D934,030 | S | 10/2021 | Gillespie |
| 11,800,943 | B2 | 10/2023 | Kwak |
| 2016/0227922 | A1 | 8/2016 | Khiabani |
| 2016/0249753 | A1 | 9/2016 | Waksul |
| 2016/0324352 | A1 | 11/2016 | Johnson-Lewis |
| 2019/0320823 | A1 | 10/2019 | Stephens |
| 2019/0350396 | A1 | 11/2019 | Steele |
| 2021/0177213 | A1 | 6/2021 | Young |

FOREIGN PATENT DOCUMENTS

| | | |
|---|---|---|
| FR | 2898481 | 9/2007 |
| WO | WO2021092268 | 5/2021 |

OTHER PUBLICATIONS

PCT International Search Report and Written Opinion, PCT International Appl. No. PCT/US20/59232, International Filing Date: Nov. 5, 2020, Applicant: Janet Kwak, mailed Apr. 22, 2021.
PCT International Preliminary Report on Patentability, PCT International Appl. No. PCT/US20/59232, International Filing Date: Nov. 5, 2020, Applicant: Janet Kwak, mailed May 10, 2022.

*Primary Examiner* — Andrew D Perreault
(74) *Attorney, Agent, or Firm* — Heisler & Associates

(57) ABSTRACT

Quality modular dinnerware set that expands to multiple configurations for a variety of hosting/serving/dining needs. Basic plates can be used to bake, serve, display, and/or cook for small or large parties. Each plate/unit has a flippable or foldable design so that every piece can be used in more than one way. The plates then can be used on its own, as well as in the microwave, oven, or over a fire, and then paired with any of the wooden accessories to create a personalized tablescape.

20 Claims, 11 Drawing Sheets

REVERSIBLE MULTI-CONFIGURATION MODULAR DINNERWARE / COOKWARE / SERVEWARE APPARATUS AND METHOD

PRIORITY APPLICATIONS

This non-provisional patent application is a continuation of U.S. patent application Ser. No. 17/420,044, filed Jun. 30, 2021, which is a non-provisional national phase U.S. utility patent application claiming priority to Patent Cooperation Treaty Patent Application No. PCT/US20/59232, filed Nov. 5, 2020; which claims the benefit of priority to U.S. Provisional Patent Application entitled, "REVERSIBLE MULTI-CONFIGURATION MODULAR DINNERWARE/COOKWARE/SERVEWARE APPARATUS AND METHOD", having Ser. No. 62/931,111, filed Nov. 5, 2019, each of which is hereby incorporated by reference herein in its entirety.

TECHNICAL FIELD

This patent document pertains generally to serveware, bakeware, cookware, ovenware, and dinnerware, and more particularly, but not by way of limitation, to a reversible multi-configuration modular dinnerware/cookware/serveware apparatus and method.

BACKGROUND

Related Art

Dinnerware is still a wide open field with a plethora of options. It is heavy and singular in usage, often requiring multiple pieces to set a table. Regardless of what cooking demands are, preparing an array of housewares can be a hassle, which is why multi-functional kitchen tools have gained in popularity. With more people living in dense cities and smaller spaces, there is also less storage for non-essential wares in the kitchen. Moreover, the composition of households is shifting away from the nuclear family, shaping different dining and tablescape preferences (family style, single, married, roommates, etc.). Products must fit consumers' spaces as well as fit the needs of those occupying them, with a high value on time saving products. In a study of dining customs, a need exists for a versatile dinnerware set that can take on multiple jobs: oven-to-table pieces that are not only dinnerware, but also act as cookware, bakeware, and serveware in order to save space, time, and money for the modern household.

Contemporary kitchen tools have moved forward in design and functionality, however ceramic dinnerware has not changed as substantially (plate is a plate, a bowl a bowl, and the like) often in similar shapes and stacking arrangements. When space is at a premium, cutting down on clutter is key in the kitchen. There is not enough space for dinnerware (plate and cups), cookware (oven-safe pieces), bakeware (muffin tins, cake pans), or flameware (stovetop pieces) for millenials who will be overtaking baby boomers in population globally in 2020 in home buying, rentals, and in population. Millennials are looking for more quality, high performing, thoughtfully designed sets that don't take up a lot of space and can do more with less.

Currently the home furnishing sector is worth an estimated $136 billion, but has been struggling to meet the needs of a younger, more frugal and resourceful generation. They offer a lot of monotony in product offerings and the discovery can often be cumbersome and overwhelming with too many cheap and trendy alternatives (plastic, melamine, glass derivative, etc). Eating or drinking off a plate/bowl/mug is the primary usage for traditional dinnerware sets. To entertain guests at home, one would need to buy extra, bulkier serving/bakeware dishes.

Bakeware and serveware crowd cupboard space and are often found in a kitchen, although they may not be used everyday.

Millennials make up 83 million people in the United States of which 36% are homebuyers, and will overtake baby boomers in 2020. They grew up during the recession, entered a struggling job market with record student debt, and do a lot of their shopping after researching online. They're value, quality, time, and tailored experiences. For urban dwellers, space is a luxury, and the kitchen has replaced the living room as the social hangout spot. Millennials are poised to be the nation's biggest spenders, and in a bid to win over younger shoppers, home retailers are re-strategizing around small space living. But there haven't been many disruptions in ceramic housewares, particularly focusing on a product that can do the work of two so that space and money is saved.

BRIEF DESCRIPTION OF THE DRAWINGS

The various embodiments are illustrated by way of example, and not by way of limitation, in the figures of the accompanying drawings in which.

SUMMARY

Figure 1:
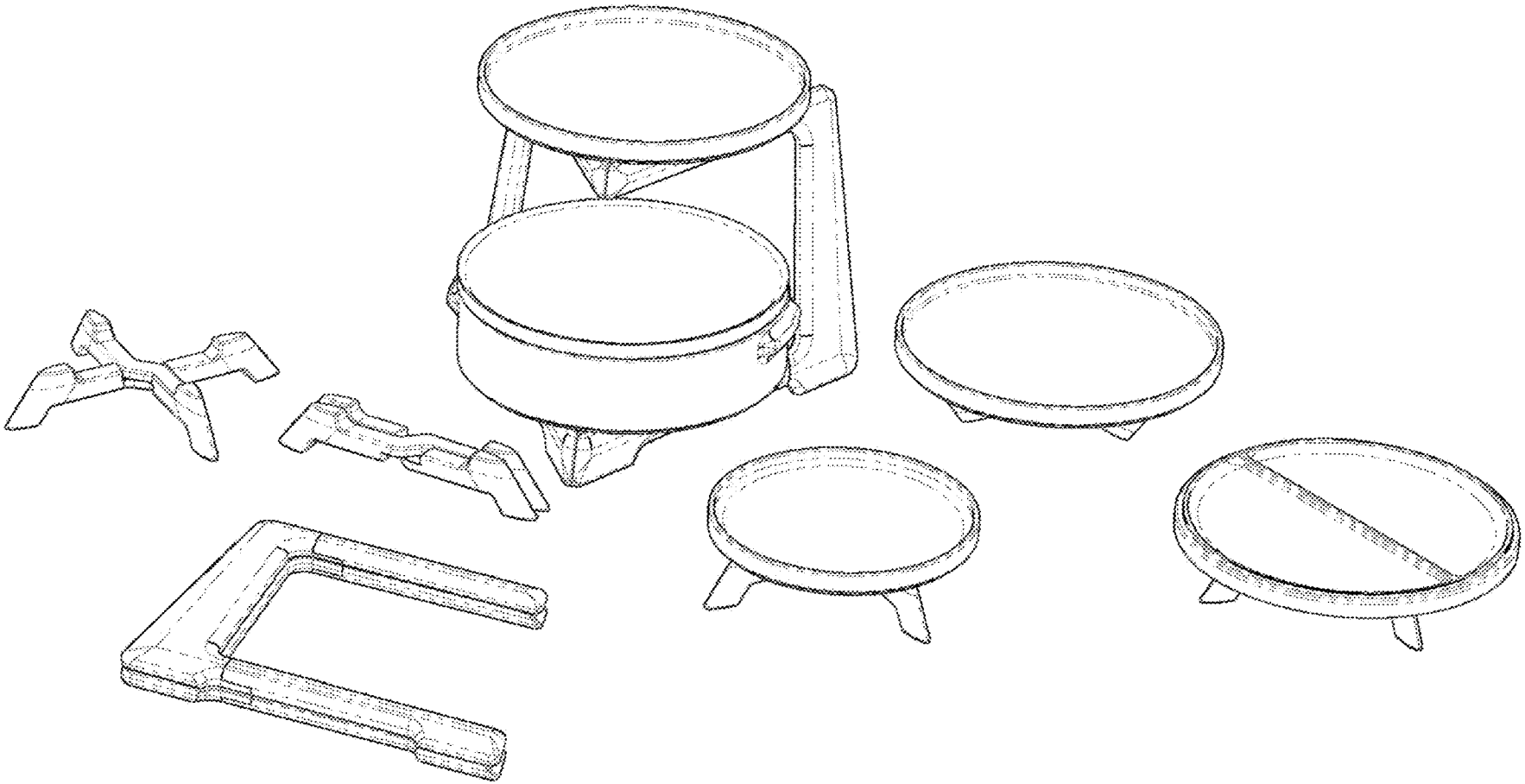
FIG. 1 illustrates an example embodiment of the serveware apparatus being a multi-functional single set adapted for versatile, adjustable, and structural use as described herein.
Figure 2:
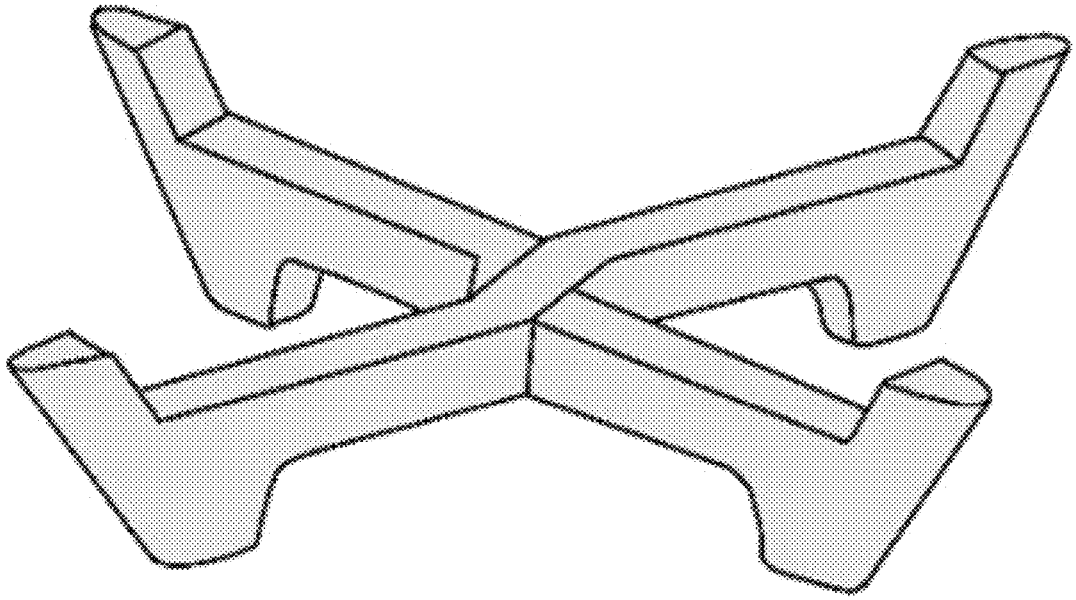
FIGS. 2 and 3 illustrate example embodiments of the trivet or plate leg accessory as described herein.
Figure 3:
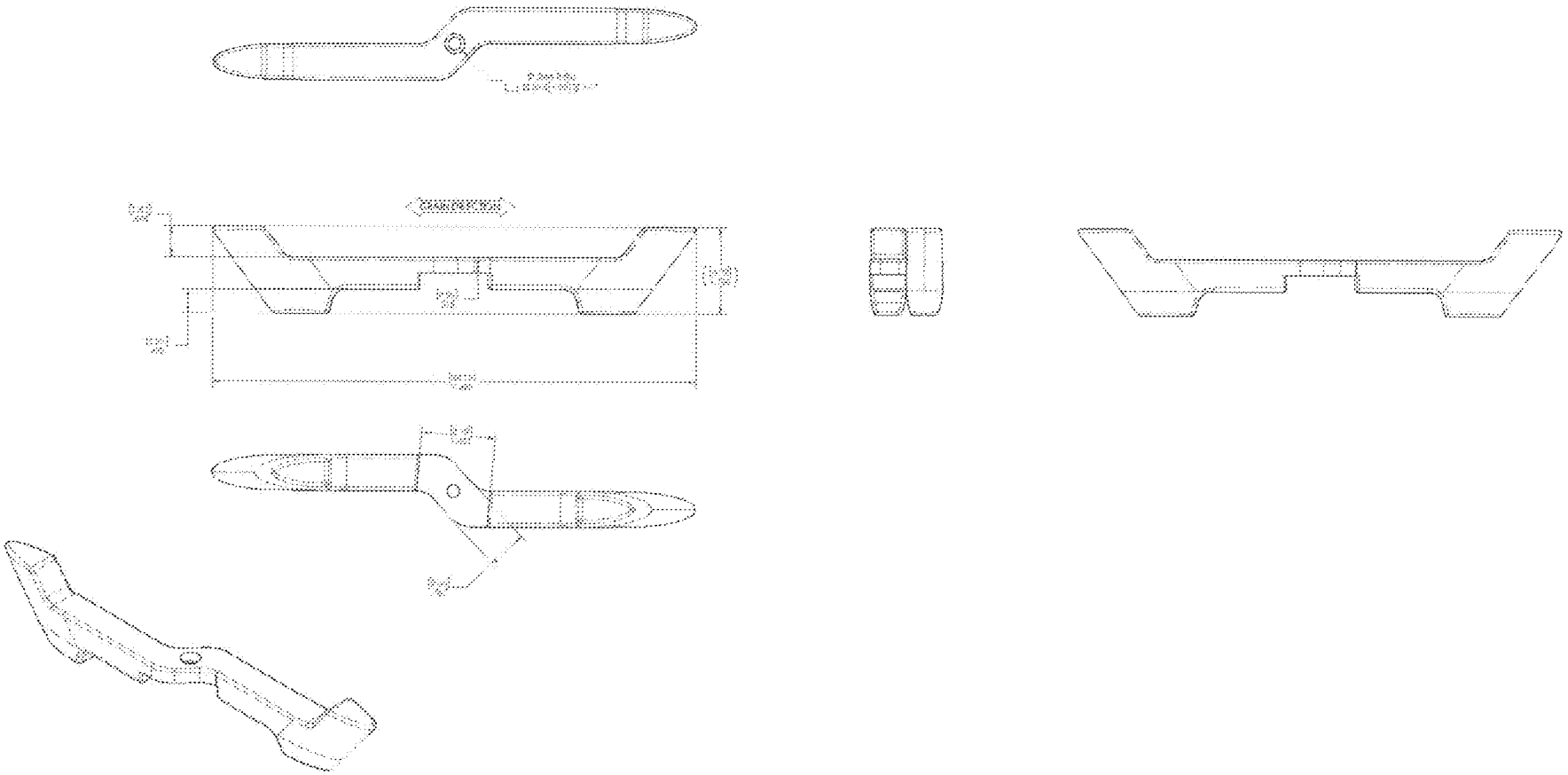
Figure 4:
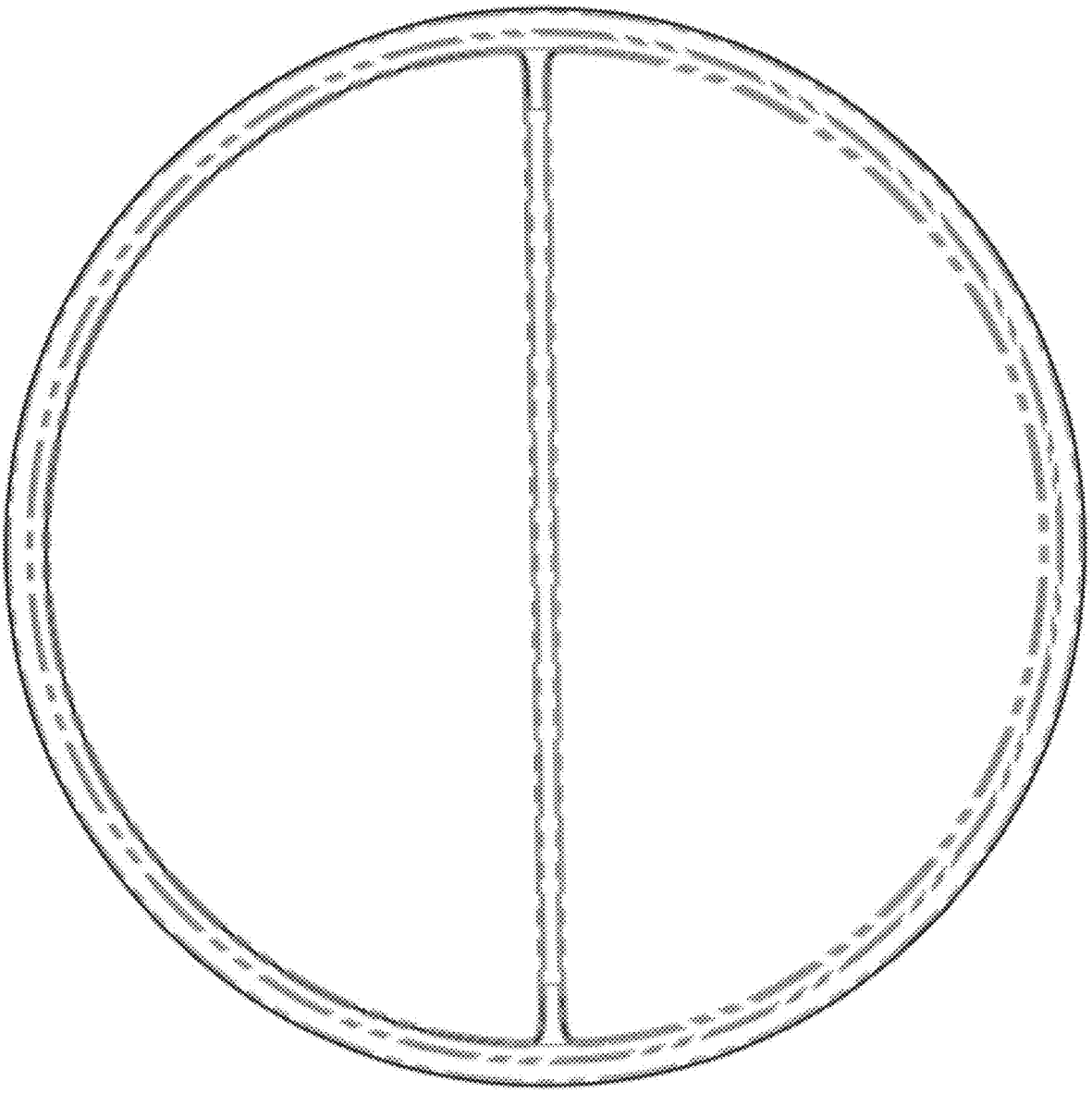
FIG. 4 illustrates an example embodiment of a partitioned plate as described herein.
Figure 5:
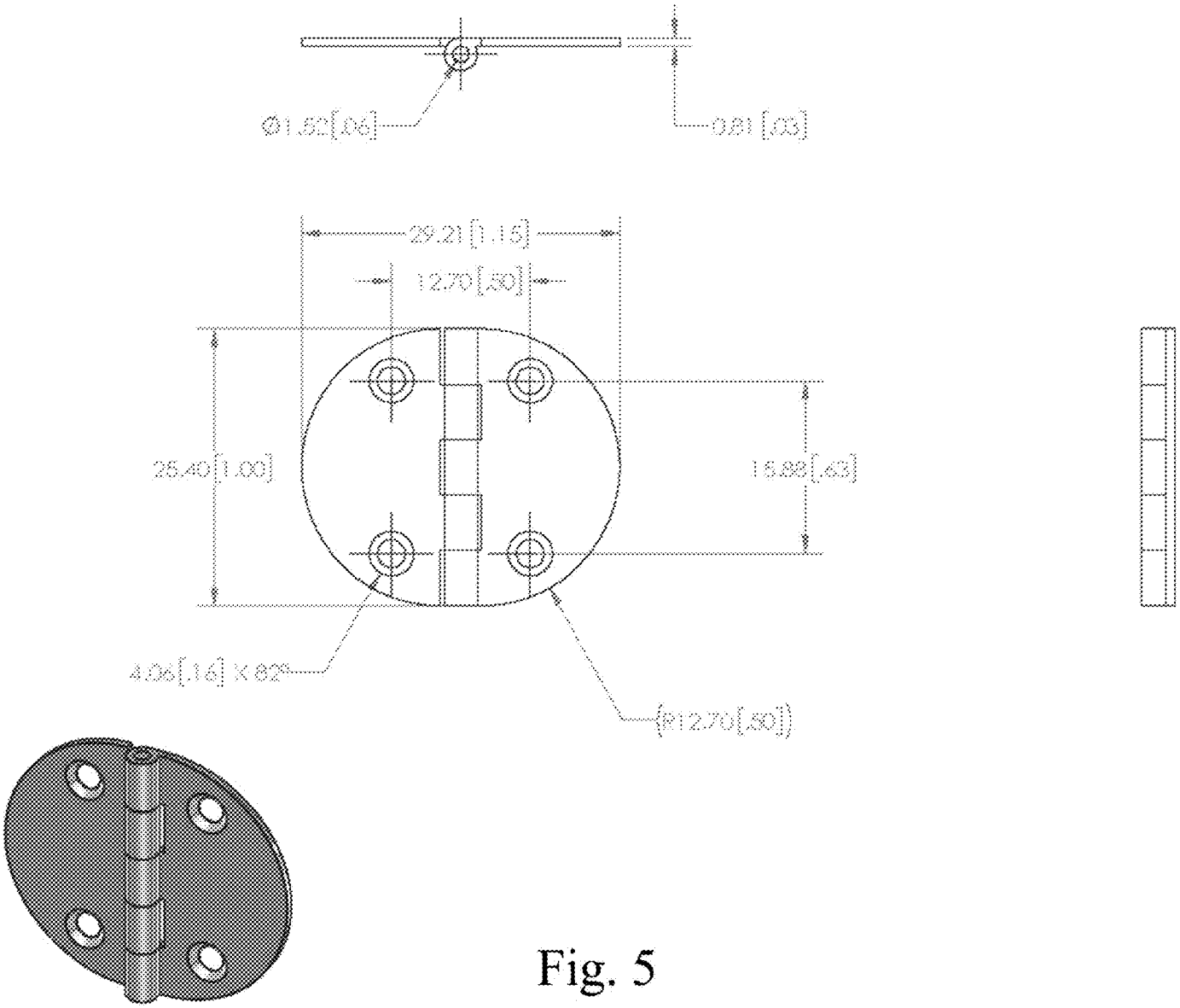
FIG. 5 illustrates an example embodiment of a hinge that can be used with the example embodiments as described herein.
Figure 6:
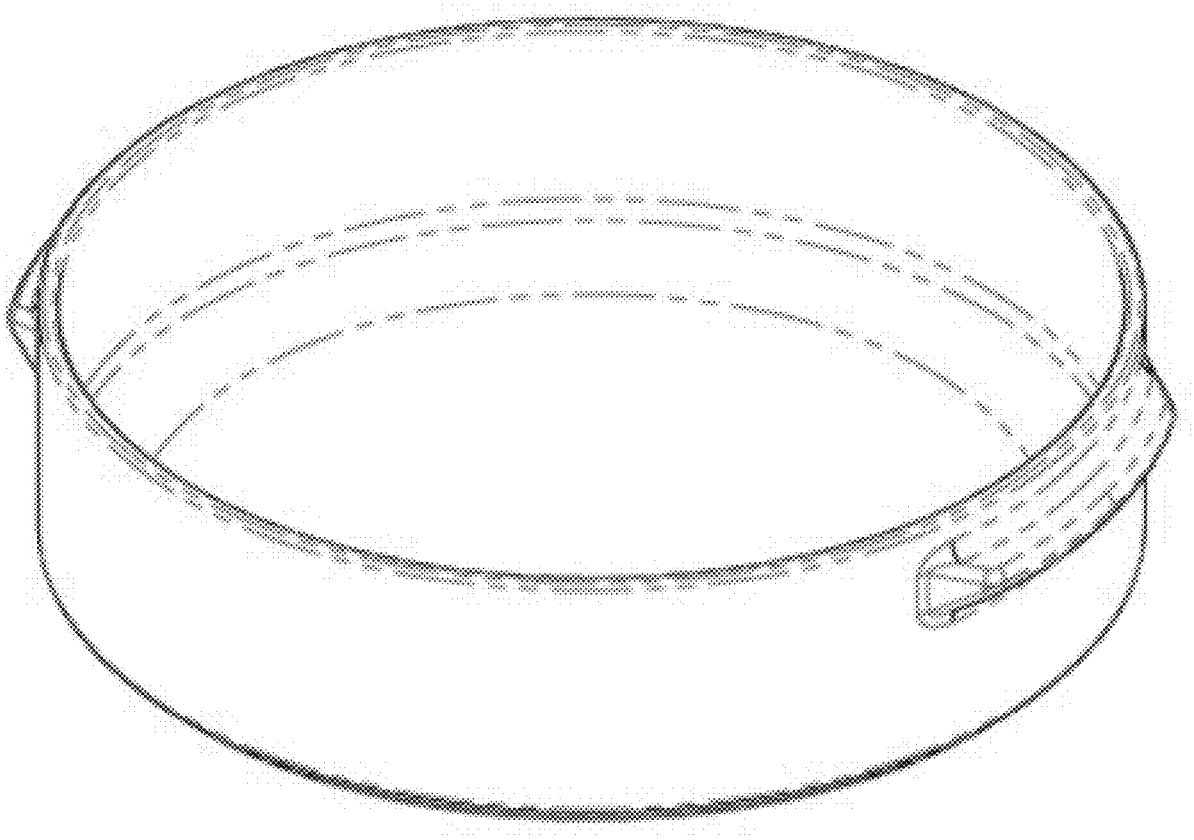
FIG. 6 illustrates an example embodiment of a bowl, casserole dish, or cookware as described herein.
Figure 7:
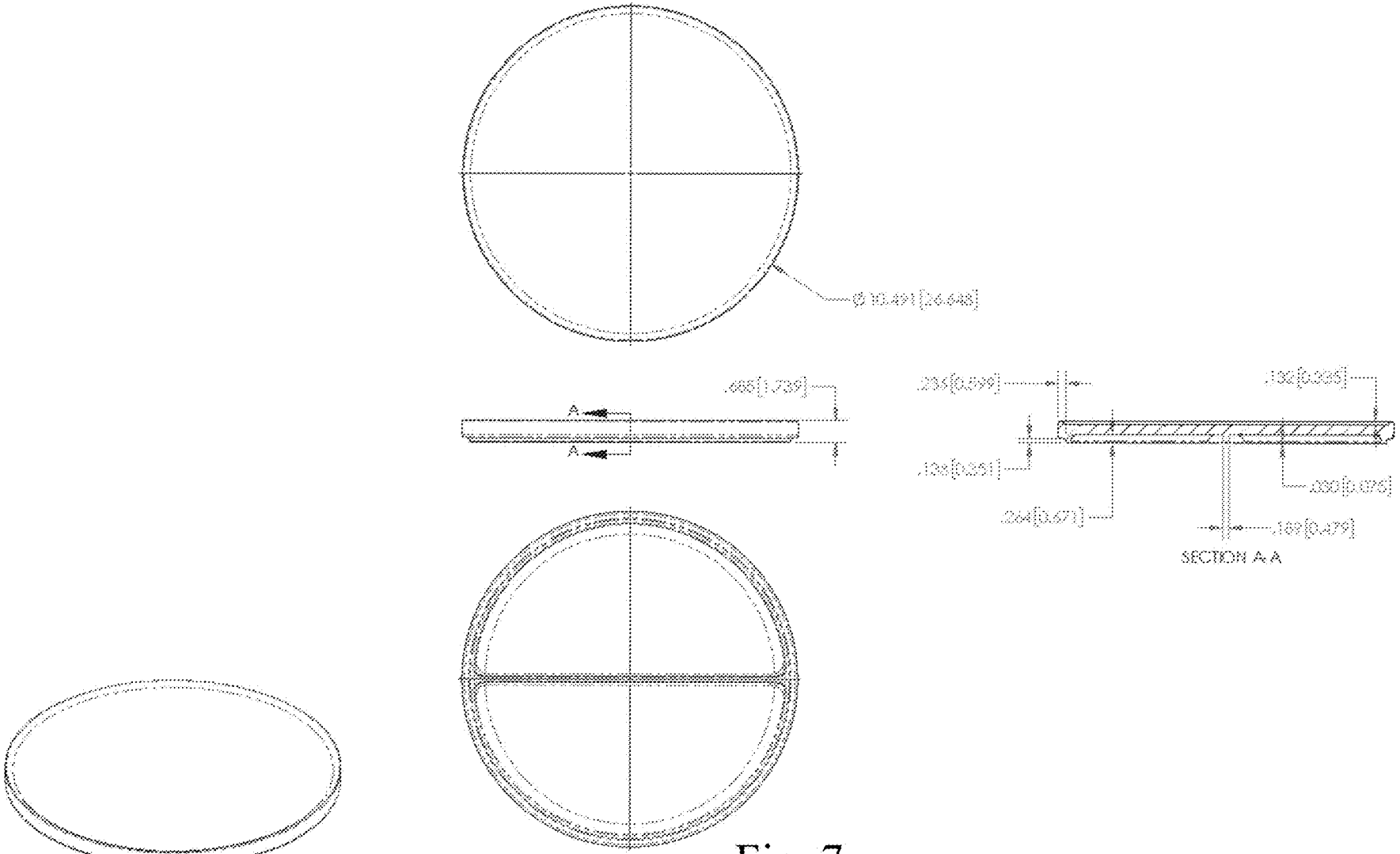
FIG. 7 illustrates an example embodiment of a lid as described herein.
Figure 8:
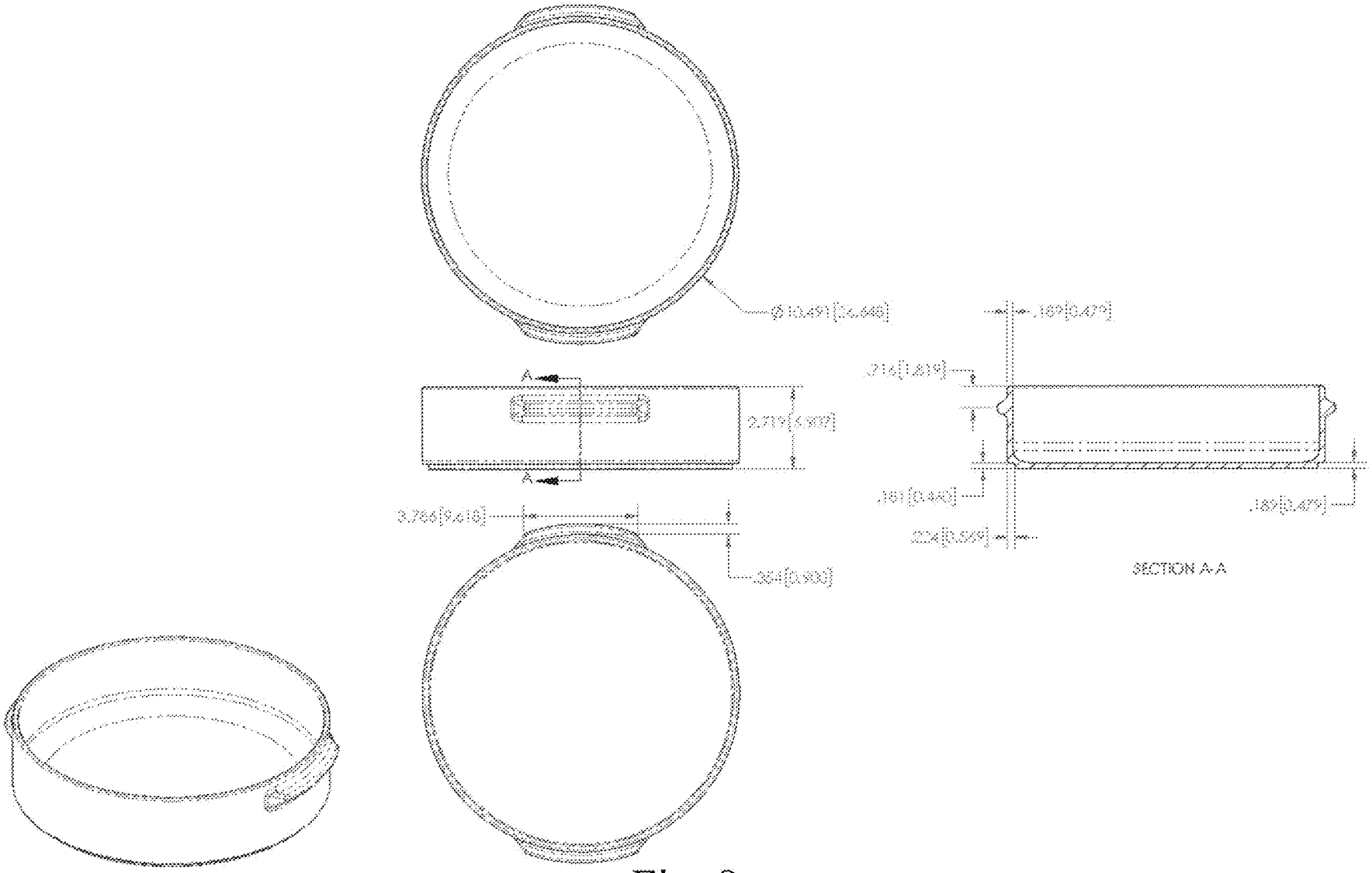
FIG. 8 illustrates another example embodiment of a bowl, casserole dish, or cookware as described herein.
Figure 9:
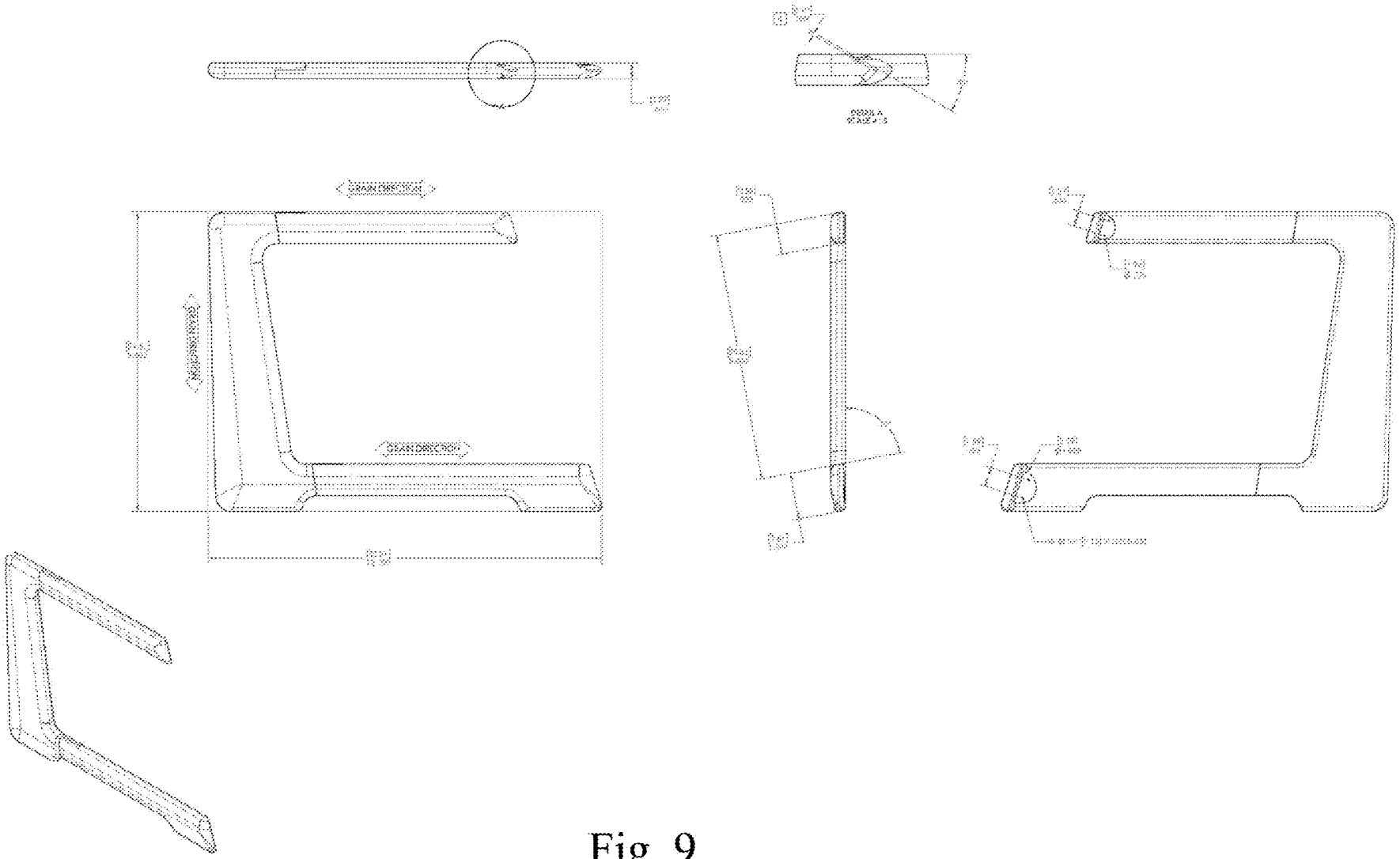
FIG. 9 illustrates an example embodiment of a tiered stand as described herein.
Figure 10:
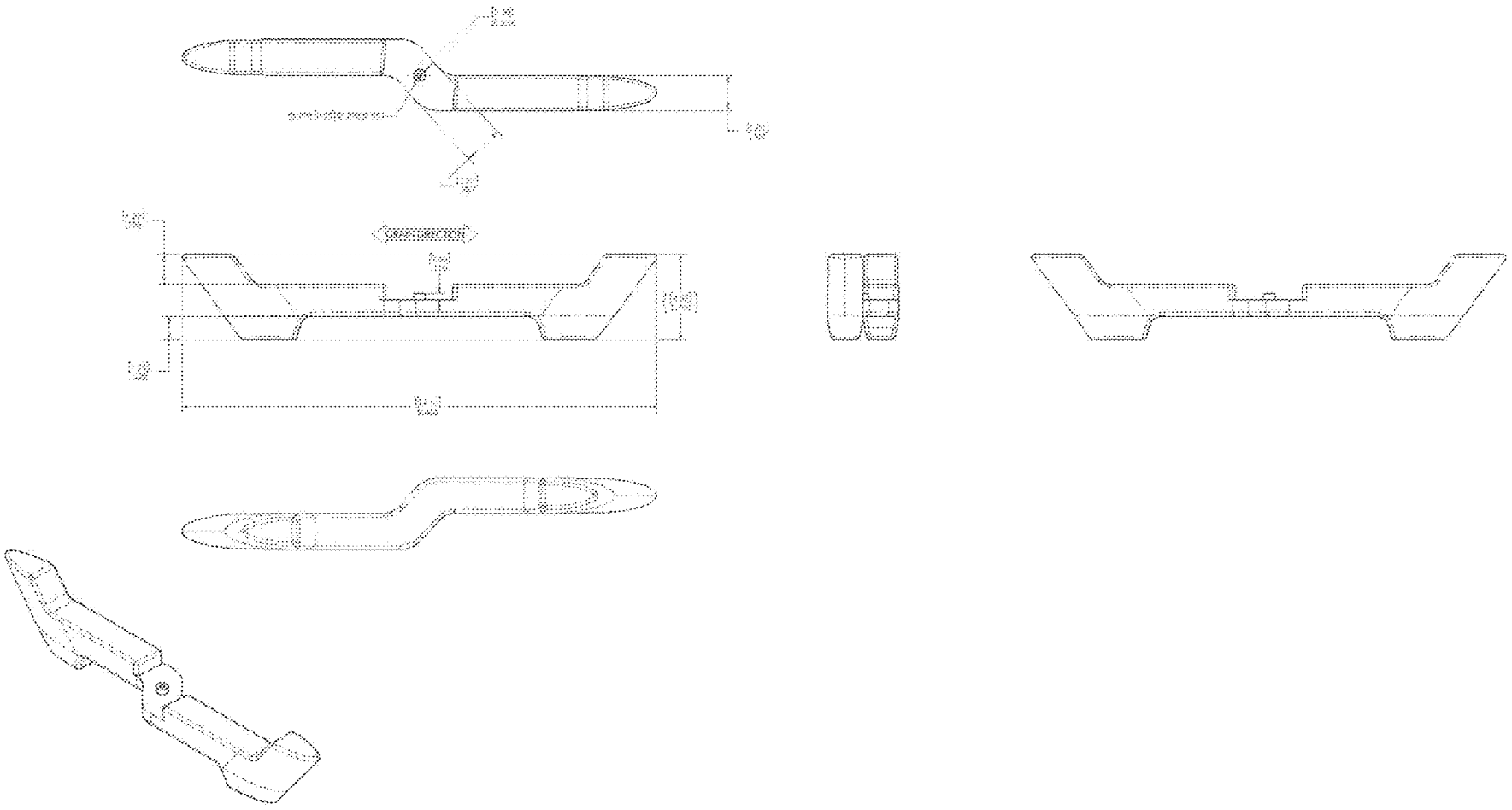
FIG. 10 illustrates another example embodiment of the trivet or plate leg accessory as described herein.
Figure 11:
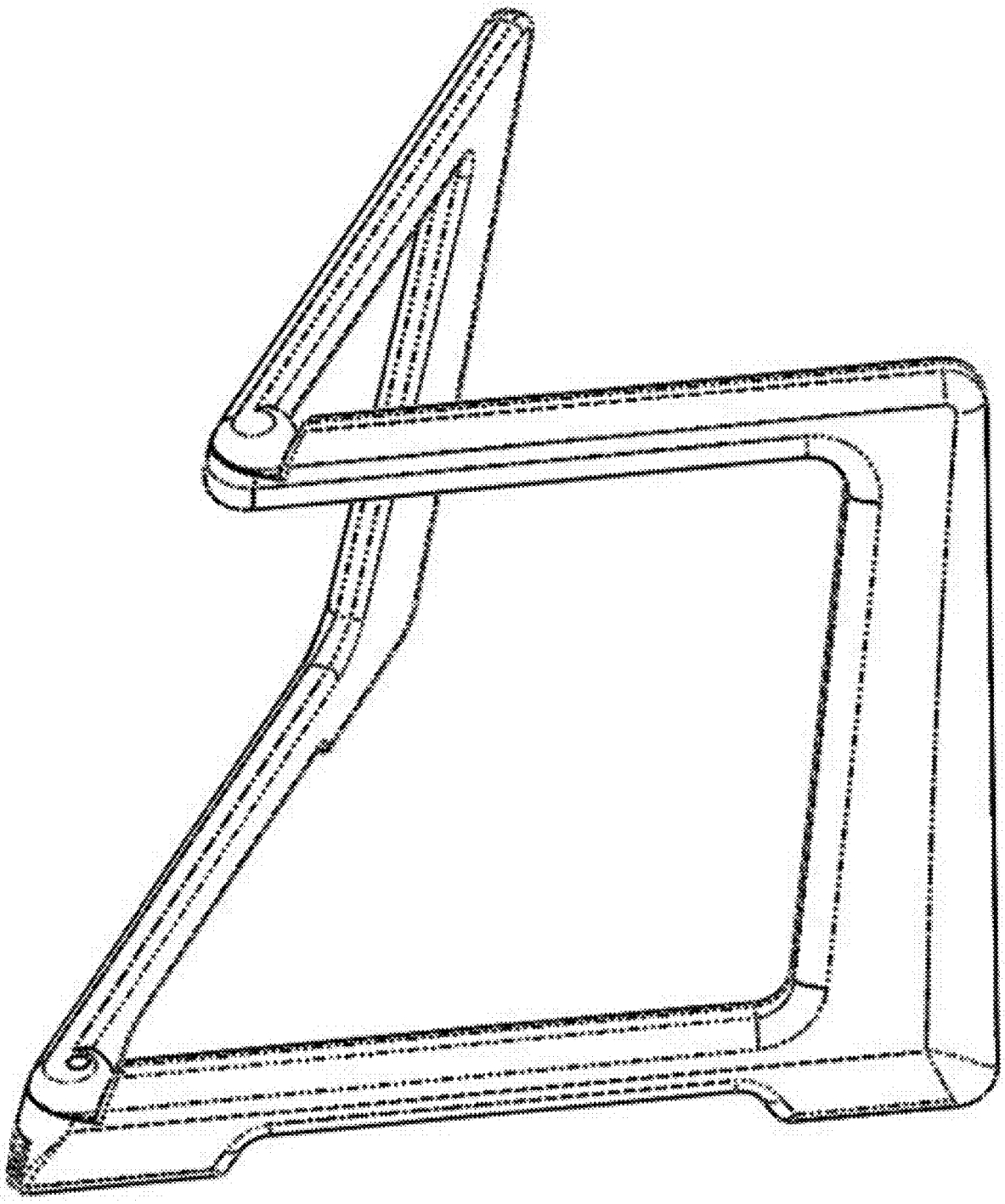
FIG. 11 illustrates another example embodiment of a tiered stand as described herein.

A multi-functional dinnerware set that is interchangeable as bakeware, cookware, and serveware and can multiply to dozens of different mealtime configurations. The apparatus is made from ceramics and wood, consisting of reversible plates and lids that can be used on both sides, each side offering a different design. Plates, lids, and bowls interact with wooden accessories that prop them up into a completely different kitchen tool. A single bowl, for example, can double as a casserole dish, a tiered appetizer display, or a family style salad platter. A plate with two configurations in one can utilize its partitioned underside to bake and cook different foods at the same time, flipped over to be used as a charcuterie board, or perched on a trivet to create a cake stand. Specific clay properties make each ceramic piece oven, microwave, dishwasher and/or flame safe. This modular set neatly stacks into a single average kitchen shelf. The flippable, stackable, foldable products are made to accommodate a variety of needs and party sizes.

DETAILED DESCRIPTION

Overview

The present teachings describe an all-in-one set which alleviates pain points for smaller spaces, changing household composition, and kitchen clutter by doing the work of multiple housewares. It could be applied in a variety of cooking, cleaning, and entertaining methods and stored, taking up little space.

Pain Points (1) Storage space: As the demand for housing goes up, with urban and small space living on the rise, people are opting to downsize and are being squeezed into tighter living quarters. This means less room for non-essentials, limiting cupboard and kitchen space for dining and cooking needs.

(2) Cooking and Cleaning methods: Ceramic dinnerware may not always be microwaveable, dishwasher, oven, or flame safe, making it confusing for consumers on how to utilize and clean it quickly and easily. Cooking and dining with ceramics is heavy, cumbersome, and time consuming, and different clay bodies requiring different cleaning and heating methods make it difficult for the consumer to manage. Moreover, many ceramic offerings are recommended to be hand washed, and cannot withstand drastic temperature changes without cracking or shattering, lacking flexibility and versatility.

(3) Overwhelming Product Discovery: There are too many options for ceramic kitchenware—mugs, bowls, baking pans, cake stands, chopping boards, baking dishes, dutch ovens, and other dinnerware. So many items are required to make, hold, and store meals, often resulting in buying and storing pieces you may only use every once in awhile.

Novelty Factors (1) Reversible plates that flip offer up two configurations in one plate. A plate can be both partitioned and non-partitioned, glazed and unglazed, or exhibit two different glazes from one side to the other. Walled plates keep food in while built-in underside dividers work as a spill guard to carry different kinds of food (i.e.: wet and dry). Two-plates-in-one allows the consumer to customize which side to use for different foods and occasions.

(2) Modular Design: All ceramicware (mugs, plates, saucers, teapots, dishes, bowls, baking dishes) will fit smartly together so that they stack in "towers" instead of plates stacking on top of other plates, bowls on bowls only, and mugs just sitting next to each other. For example, a plate can stack on a casserole dish and a salad bowl. All plates and bowls can be stored on a folding tiered stand, which not only displays plates for entertaining, but is used as a storage mechanism as well.

(3) Foldable design: Wooden accessories fold flat so they can be stored easily and save space. Plate legs that act as display stands can also be folded and used as a hot plate trivet to protect a table from the heat. Wooden accessories interact with the ceramic components to change the function of each piece: turning ceramic plates into a cake stand, an elevated centerpiece, or tiered display.

(4) Multi-functional Versatility: a single set is used as dinnerware, serveware, and/or cookware and allows for dozens of tablescape configurations.

Dinner plates are flippable/reversible (each plate inherently carries two different designs) made of ceramics. The top design is a regular non-partitioned walled plate to keep food from spilling, and the bottom has a different glaze color, texture, or a built-in divider that can keep foods separated. In one exemplary embodiment, a bottom has a built-in divider that doubles as a spill guard and wall to keep different foods separated.

A wooden set of legs that can be flipped over and opened to elevate different sized plates as a trivet or a focal piece.

A wooden tiered stand that can hold up to two plates on different tiers as a display tray, serving set, or storage rack.

Each flippable ceramic ware can come in varying heights (i.e., short for dinnerplate, tall with handle for a bowl or casserole dish).

The foldable wooden legs are an "X" shaped design that opens and closes. When swung open, it can be used as a holding stand or hot plate trivet.

The foldable wooden tiers used as a food display or storage rack can be folded flat for easy organization.

Wooden versions of the flippable plates to be used as lids can stack with the ceramic counterparts, and can be used just like the plates to hold and display food.

Different materials for which the present invention may be composed include, inter alia, glass, tempered glass product, metals, and different types of wood, including bamboo. These could make it more kid-friendly, disposable, or cheaper to fit a different market. Physical properties include materials that have a low thermal expansion that can withstand sudden changes in temperature without cracking. It may also be resistant to thermal shock. It may be vitreous in nature, and less susceptible to crazing or cracking when subjected to sudden heat or cold.

Different designs: mugs, saucers, teapots, pitchers that stack similarly and can be stowed away in "towers" and have more than one usage.

Different design handle: handle sizes for the taller bowl and cookware may vary in size and shape, compared to the extruded triangle shape on the bowl.

More wooden accessories that would create different serveware functions when paired with ceramic designs.

The foregoing description illustrates exemplary implementations, and novel features, of aspects of a REVERSIBLE MULTI-CONFIGURATION MODULAR DINNERWARE/COOKWARE/SERVEWARE APPARATUS AND METHOD apparatus.

Alternative implementations are suggested, but it is impractical to list all alternative implementations of the present teachings. Therefore, the scope of the presented disclosure should be determined only by reference to the appended claims, and should not be limited by features illustrated in the foregoing description except insofar as such limitation is recited in an appended claim.

While the above description has pointed out novel features of the present disclosure as applied to various embodiments, the skilled person will understand that various omissions, substitutions, permutations, and changes in the form and details of the present teachings illustrated may be made without departing from the scope of the present teachings.

Each practical and novel combination of the elements and alternatives described hereinabove, and each practical combination of equivalents to such elements, is contemplated as an embodiment of the present teachings. Because many more element combinations are contemplated as embodiments of the present teachings than can reasonably be explicitly enumerated herein, the scope of the present teachings is properly defined by the appended claims rather than by the foregoing description. All variations coming within the meaning and range of equivalency of the various claim elements are embraced within the scope of the corresponding claim. Each claim set forth below is intended to encompass any apparatus or method that differs only insubstantially from the literal language of such claim, as long as such apparatus or method is not, in fact, an embodiment of the prior art. To this end, each described element in each claim should be construed as broadly as possible, and moreover should be understood to encompass any equivalent to such element insofar as possible without also encompassing the prior art. Furthermore, to the extent that the term "includes" is used in either the detailed description or the claims, such term is intended to be inclusive in a manner similar to the term "comprising".

I claim:

1. A serveware apparatus being a multi-functional single set adapted for versatile, adjustable, and structural use, the serveware apparatus comprising:

a plate element comprises a top side and a bottom side, wherein the top side and the bottom side are reversible with different structural elements on each side;

a leg element comprises at least two legs coupled at a center of each leg thereby forming a hinged "X" shape that opens and closes, each of the at least two legs having a first side and a second side, wherein the first side and the second side are reversible with different structural elements on each side, each of the at least two legs comprises a first raised end on the first side and a second raised end on the second side; and a foldable tiered stand comprises at least two supports coupled at ends of each support thereby forming a hinged "U" shape that opens and closes, the open configuration providing support surfaces at two different levels to support at least two different plate elements, at least one plate element being supported on the foldable tiered stand.

2. The serveware apparatus of claim 1, wherein the top side of the plate element having a walled element around the circumference of the plate element to prevent spillage, both the top side and the bottom being useable as a dinner plate or serving plate.

3. The serveware apparatus of claim 1, wherein the plate element is partitioned on one side and non-partitioned on a reverse side, the partitioned side dividing the plate element into a plurality of separate food retaining regions.

4. The serveware apparatus of claim 1, wherein the plate element is glazed on one side and unglazed on a reverse side.

5. The serveware apparatus of claim 1, wherein the plate element comprises a dimension to accept a different plate element in a stacked arrangement.

6. The serveware apparatus of claim 1, wherein the leg element is folded flat in a closed configuration.

7. The serveware apparatus of claim 1, wherein the foldable tiered stand is folded flat in a closed configuration.

8. The serveware apparatus of claim 1, wherein the two different levels of the foldable tiered stand are horizontally offset.

9. The serveware apparatus of claim 1, wherein the plate element is fabricated from a material selected from a group consisting of: ceramic, glass, a tempered glass product, metal, and wood.

10. The serveware apparatus of claim 1, wherein the leg element is fabricated from a material selected from a group consisting of: metal and wood.

11. The serveware apparatus of claim 1, wherein the foldable tiered stand is fabricated from a material selected from a group consisting of: metal and wood.

12. The serveware apparatus of claim 1, wherein the plate element is fabricated from a material that has a low thermal expansion and is resistant to thermal shock.

13. The serveware apparatus of claim 1, wherein the leg element and the foldable tiered stand are symmetrical in at least one dimension.

14. The serveware apparatus of claim 1, wherein the apparatus includes serveware, bakeware, cookware, ovenware, and dinnerware.

15. The serveware apparatus of claim 1, wherein at least three different plate elements are placed in a stacked arrangement.

16. The serveware apparatus of claim 1, further including a bowl element comprising a top opening and a handle on an outer surface, the top opening comprises an opening dimension wherein the opening dimension accepts the plate element in a stacked arrangement, the plate element being stacked within the bowl element, the first side of the leg element further comprises a retaining dimension wherein the retaining dimension accepts the bowl element in a stacked arrangement, the bowl element being stacked on the first side of the leg element.

17. The serveware apparatus of claim 16, wherein a plurality of bowl elements are placed in a stacked arrangement.

18. The serveware apparatus of claim 16, wherein a plurality of plate elements and a plurality of bowl elements are placed in a stacked arrangement.

19. The serveware apparatus of claim 16, wherein the bowl element is fabricated from a material selected from a group consisting of: ceramic, glass, a tempered glass product, metal, and wood.

20. The serveware apparatus of claim 16, wherein the bowl element is fabricated from a material that has a low thermal expansion and is resistant to thermal shock.

* * * * *